US009701497B2

(12) United States Patent
Washino

(10) Patent No.: US 9,701,497 B2
(45) Date of Patent: Jul. 11, 2017

(54) SHEET TRAY

(71) Applicant: Brother Kogyo Kabushiki Kaisha, Nagoya-shi, Aichi-ken (JP)

(72) Inventor: Yoshiyuki Washino, Hashima-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/060,710

(22) Filed: Mar. 4, 2016

(65) Prior Publication Data

US 2016/0289016 A1 Oct. 6, 2016

(30) Foreign Application Priority Data

Mar. 31, 2015 (JP) ..... 2015-071820

(51) Int. Cl.
*B65H 1/00* (2006.01)
*B65H 1/26* (2006.01)

(52) U.S. Cl.
CPC ..... *B65H 1/266* (2013.01); *B65H 2402/32* (2013.01); *B65H 2403/47* (2013.01); *B65H 2405/1122* (2013.01); *B65H 2405/11164* (2013.01); *B65H 2511/11* (2013.01); *B65H 2511/20* (2013.01)

(58) Field of Classification Search
CPC ..... B65H 1/266; B65H 2405/1122; B65H 2511/11; B65H 2403/47; B65H 2402/32; B65H 2405/111
See application file for complete search history.

(56) References Cited

U.S. PATENT DOCUMENTS 8,469,357 B2 * 6/2013 Furusawa ..... B65H 1/266 271/171
RE44,947 E * 6/2014 Kawamura ..... B65H 1/26 271/145
9,346,635 B2 * 5/2016 Hirata ..... B65H 1/266
9,511,961 B2 * 12/2016 Murashima ..... B65H 1/266

FOREIGN PATENT DOCUMENTS

JP 2003-128268 A 5/2003

* cited by examiner

*Primary Examiner* — Jeremy R Severson
(74) *Attorney, Agent, or Firm* — Banner & Witcoff, Ltd.

(57) ABSTRACT

A second tray is movable along a first direction, relative to a first tray, between a first position and a second position. The second tray includes a rail extending along the first direction, and engagement portions disposed along the rail. The rail includes an overlap portion which overlaps a sheet support surface of the first tray when the second tray is at the first position. A guide member is supported by the rail and movable along the first direction to contact an edge of a sheet supported by the second tray. A contact portion of the first tray disengages the guide member from one of the engagement portions upon contact with the guide member during movement of the second tray from the second position toward the first position while the guide member is supported at the overlap portion of the rail.

10 Claims, 11 Drawing Sheets

SHEET TRAY

CROSS-REFERENCE TO RELATED APPLICATION

This application claims priority from Japanese Patent Application No. 2015-071820, filed on Mar. 31, 2015, which is incorporated herein by reference in its entirety.

TECHNICAL FIELD

Aspects described herein relate to a sheet tray configured to support one or more sheets thereon.

BACKGROUND

A known image recording device, such as a copier and a printer, includes a sheet conveying device. The sheet conveying device includes a sheet tray configured to support sheets. The sheet tray is extendable and retractable so as to support large size sheets while the image recording device remains compact. The sheet tray includes a main tray, a slide tray extendable and retractable relative to the main tray, and a rear guide for positioning rear edges of sheets.

SUMMARY

It may be beneficial to provide a sheet tray to which a rear guide is mounted while rigidity of the sheet tray is maintained and which is extendable and retractable without being interfered by the rear guide.

According to one or more aspects of the disclosure, a sheet tray comprises a first tray, a second tray, and a guide member. The first tray includes a first support surface configured to support a sheet, and a first contact portion. The second tray is attached to the first tray and movable along a first direction between a first position and a second position. The second tray includes a second support surface, a rail, and a plurality of engagement portions. The second support surface is configured to support a sheet and overlap, from below, the first support surface over a first area when the second tray is at the first position, and overlap, from below, the first support surface over a second area when the second tray is at the second position. The second area is smaller than the first area. The rail is formed in the second support surface and extends along the first direction. The rail includes an overlap portion configured to overlap the first support surface when the second tray is at the first position. The plurality of engagement portions are disposed along the rail. The guide member is supported by the rail and movable along the first direction to contact an edge, in the first direction, of the sheet supported by the second support surface. The guide member includes an engagement shifter changeable between a first state in which the guide member is engaged with one of the plurality of engagement portions and locked from moving, and a second state in which the guide member is disengaged from the plurality of engagement portions and movable. The first contact portion of the first tray is configured to change the engagement shifter from the first state to the second state by contacting the engagement shifter during movement of the second tray from the second position toward the first position while the guide member is supported at the overlap portion of the rail.

According to one or more aspects of the disclosure, a sheet tray comprises a first tray, a second tray, and a guide member. The first tray includes a first support surface configured to support a sheet, and a first contact portion. The second tray is attached to the first tray and movable along a first direction between a first position and a second position. The second tray includes a second support surface and a rail. The second support surface is configured to support a sheet and overlap, from below, the first support surface over a first area when the second tray is at the first position, and overlap, from below, the first support surface over a second area when the second tray is at the second position. The second area is smaller than the first area. The rail extends along the first direction. The guide member is supported by the rail and movable along the first direction to contact an edge, in the first direction, of the sheet supported by the second support surface. The guide member is configured to move together with the second tray relative to the first tray before the guide member contacts the first contact portion of the first tray during movement of the second tray from the second position toward the first position, and configured to move relative to the second tray after the guide member contacts the first contact portion during movement of the second tray from the second position toward the first position.

According to one or more aspects of the disclosure, a sheet tray comprises a first tray, a second tray, and a guide member. The first tray includes a first support surface configured to support a sheet. The second tray is attached to the first tray and movable along a first direction between a first position and a second position. The second tray includes a second support surface and a rail. The second support surface is configured to support a sheet and overlap, from below, the first support surface over a first area when the second tray is at the first position, and overlap, from below, the first support surface over a second area when the second tray is at the second position. The second area is smaller than the first area. The rail extends along the first direction and includes an overlap portion configured to overlap, from below, the first support surface when the second tray is at the first position. The guide member is supported by the rail and movable along the first direction to contact an edge, in the first direction, of a sheet supported by the second support surface.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Figure 1:
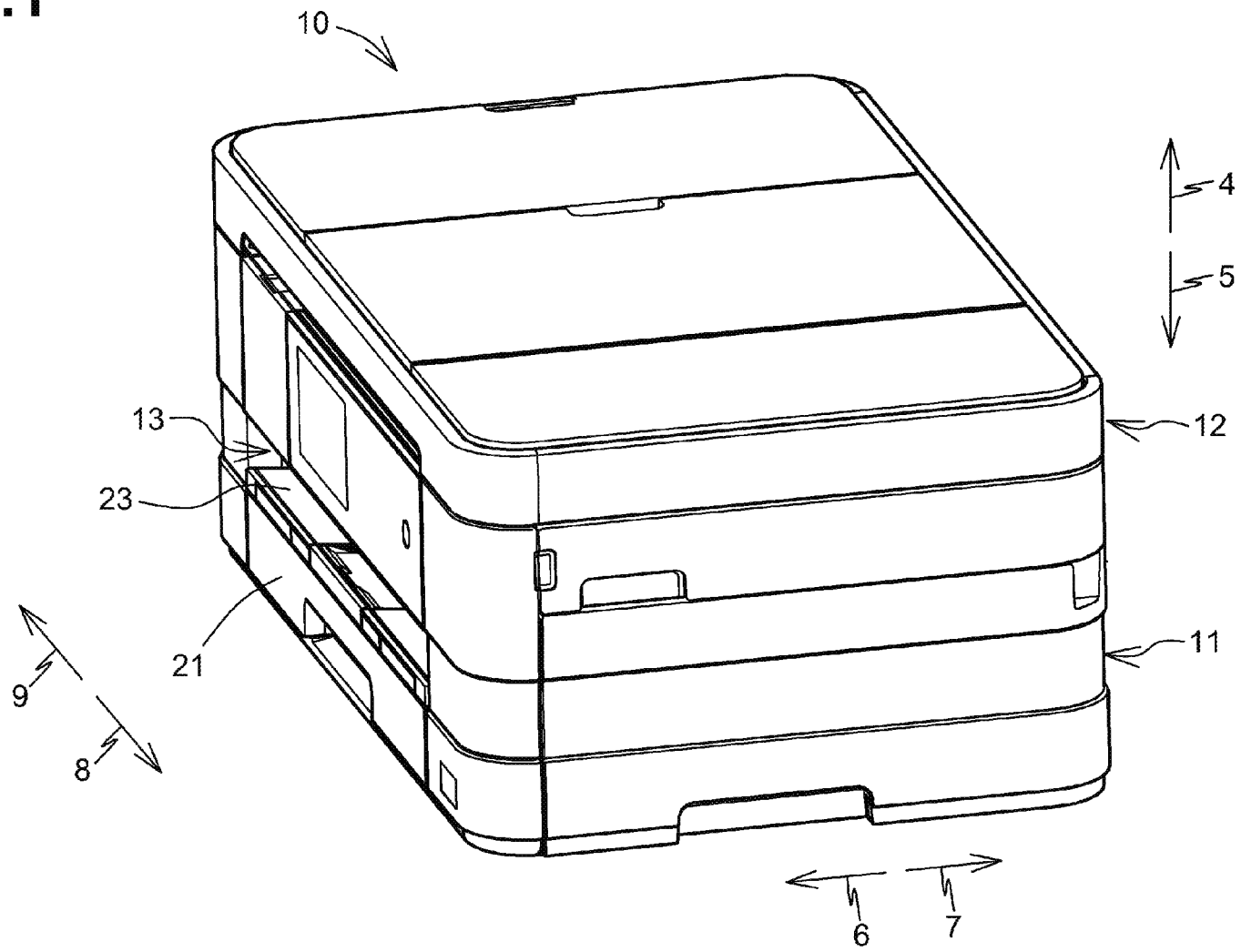
FIG. 1 is a perspective view of a multifunction device in an illustrative embodiment according to one or more aspects of the disclosure.

An illustrative embodiment according to one or more aspects of the disclosure will be described below. The disclosure is merely an example and various changes, arrangements and modifications may be applied therein without departing from the spirit and scope of the disclosure. An up direction 4 and a down direction 5 (collectively referred to as an up-down direction 4, 5) may be defined with reference to an orientation of a multifunction device 10 that may be disposed in an orientation in which it may be intended to be used (refer to FIG. 1). The side of the multifunction device 10, in which an opening 13 may be defined, may be defined as the front of the multifunction device 10. A front direction 6 and a rear direction 7 (collectively referred to as a front-rear direction 6, 7) may be defined with reference to the front of the multifunction device 10. A right direction 8 and a left direction 9 (collectively referred to as a right-left direction 8, 9) may be defined with respect to the multifunction device 10 as viewed from the front of the multifunction device 10.

Overall Configuration of Multifunction Device 10

As depicted in FIG. 1, the multifunction device 10 includes a scanner 12 at its upper portion and an inkjet printer 11 at its lower portion. The multifunction device 10 has multiple functions, e.g., a facsimile function and a printing function.

Figure 2:
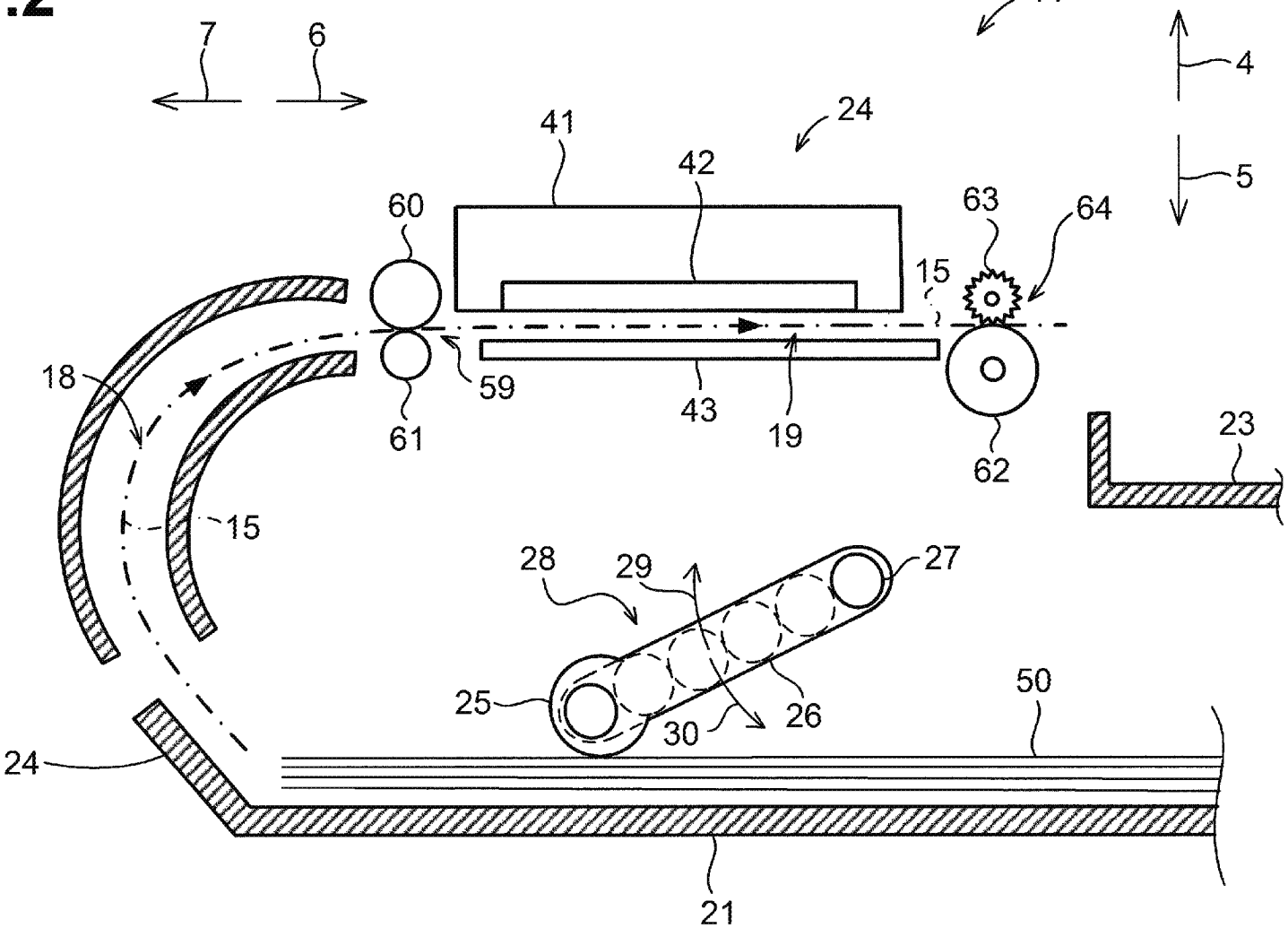
FIG. 2 is a vertical cross-sectional view depicting an internal configuration of a printer in the illustrative embodiment according to one or more aspects of the disclosure.

The printer 11 includes a conveying device and a recording unit 40 (refer to FIG. 2). The conveying device includes a feed tray 21 (as an example of a sheet tray) and a feeder 28 (refer to FIG. 2).

The printer 11 has an opening 13 at the front. The feed tray 21 is insertable into the printer 11 through the opening 13 in the rear direction 7 and removable from the printer 11 through the opening 13 in the front direction 6. Alternatively, the feed tray 21 may be drawn out partially from the printer 11 and may not be removable wholly from the printer 11.

The feed tray 21 is configured to support one or more sheets 50 (refer to FIG. 2). A sheet 50 is fed from the feed tray 21 to a conveying path 18 defined in the printer 11. A recording unit 24 records an image on the fed sheet 50, and the sheet 50 is discharged onto a discharge tray 23. The feed tray 21 will be described in detail later.

Feeder 28

As depicted in FIG. 2, the feeder 28 is located above the feed tray 21 when the feed tray 21 is inserted in the printer 11. The feeder 28 includes a feed roller 25, an arm 26, and a shaft 27. The feed roller 25 is rotatably supported at an end of the arm 26. The arm 26 is supported on the shaft 27, which is supported by a housing of the printer 11, so as to pivot about the shaft 27 in arrow directions 29, 30. The arm 26 is urged toward the feed tray 21 by its own weight or by an elastic force exerted by a spring or the like. The feeder 28 picks up a sheet 50 from the feed tray 21 and feeds the sheet 50 in the rear direction 7 (in which a second tray 72 (to be described later) moves from a second position to a first position). The sheet 50 is fed into the conveying path 18.

Conveying Paths 18, 19

As depicted in FIG. 2, conveying paths 18, 19 are defined in the printer 11. The conveying path 18 is defined above an inclined plate 24 disposed at a rear end of the feed tray 21 inserted in the printer 11. The conveying path 18 has an arcuate shape. The inclined plate 24 may be disposed at the housing of the printer 11, instead of being disposed at the feed tray 21.

The conveying path 19 continues from the conveying path 18. A sheet 50 conveyed along the conveying path 18 is conveyed along the conveying path 19. The conveying path 19 extends in the front direction 6 from a boundary with the conveying path 18 to a position above the discharge tray 23. The feed roller 25, a conveying roller pair 59, and a discharge roller pair 64 convey the sheet 50 along the conveying path 18 and the conveying path 19 in a conveying direction 15 indicated by a single-dotted and dashed line in FIG. 2.

Recording Unit 40

As depicted in FIG. 2, the recording unit 24 includes a carriage 41 configured to reciprocate in the right-left direction 8, 9, which is perpendicular to a sheet plane of FIG. 2, while carrying a recording head 42 thereon. Ink of colors of cyan, magenta, yellow, and black is supplied to the recording head 42 from a corresponding ink cartridge (not shown). The recording head 42 ejects a droplet of ink of respective colors through nozzles disposed at a lower surface thereof. The carriage 41 scans the recording head 42 relative to the sheet 50 by reciprocating in the right-left direction 8, 9, to thereby form an image on the sheet 50 conveyed over a platen 43, which is disposed below to face the recording unit 40. The platen 43 supports the sheet 50 being conveyed along the conveying path 19.

Conveying Roller Pair 59 and Discharge Roller Pair 64

As depicted in FIG. 2, the conveying roller pair 59 are disposed upstream of the recording unit 40 in the conveying direction 15. The conveying roller pair 59 includes a conveying roller 60 and a pinch roller 61. The conveying roller 60 is disposed above the conveying path 19 and is driven to rotate by a conveying motor (not shown). The pinch roller 61 is disposed below the conveying path 19 to face the conveying roller 60 and rotates by the rotation of the conveying roller 60.

The discharge roller pair 64 is disposed downstream of the recording unit 40 in the conveying direction 15. The discharge roller pair 64 includes a discharge roller 62 and a spur 63. The discharge roller 62 is disposed below the conveying path 19 and is driven to rotate by the conveying motor. The spur 63 is disposed above the conveying path 19 to oppose the discharge roller 62 and rotates by the rotation of the discharge roller 62.

The conveying roller pair 59 guides the sheet 50 fed by the feeder 28 from the feed tray 21, and the recording unit 40 records an image on the sheet 50. Then, the discharge roller pair 60 discharges the sheet 50 onto the discharge tray 23.

Feed Tray 21

As depicted in FIG. 2, the feed tray 21 is mounted in the printer 11 (in a state depicted in FIGS. 1 and 2) by being inserted, through the opening 13, in the rear direction 7 with the inclined plate 24 as a leading end. In this state, sheets 50 supported by the feed tray 21 can be fed to the conveying path 18. The feed tray 21 is removed from the printer 11 by being drawn out, through the opening 13, in the front direction 6 with the inclined plate 24 as a trailing end. In this state, the feed tray 21 can be replenished with sheets 50.

As depicted in FIGS. 3-6, the feed tray 21 is open upward and shaped like a box having a length in the front-rear direction 6, 7 and a length in the right-left direction 4, 5 which are greater than a length in the up-down direction 4, 5. The feed tray 21 includes a first tray 71 and a second tray 72.

First Tray 71

As depicted in FIGS. 3-6, the first tray 71 includes a first bottom plate 75, the inclined plate 24, and a pair of side walls 81. The first bottom plate 75 has a first support surface 75A configured to support sheets 50. The inclined plate 24 extends in an upper rear direction from a rear end of the first support surface 75A. The side walls 81 extend upward from right and left ends of the first support surface 75A so as to face each other in the right-left direction 8, 9.

Each of the side walls 81 extends in the front-rear direction 6, 7. Each of the side walls 81 includes a pair of side segments 81A, 81B spaced from each other in the right-left direction 8, 9, and a connecting segment 81C which connects upper ends of the side segments 81A, 81B. Lower ends of the side segments 81A continue to the first support surface 75A. The side segments 81B are disposed outside of the side segments 81A in the right-left direction 8, 9, respectively. In other words, the side segments 81B are disposed opposite to the first support surface 75A relative to the respective side segments 81A. Each side segment 81B includes, on its surface facing a corresponding side segment 81A, a rib which protrudes toward the side segment 81A and extends in the front-rear direction 6, 7.

Each of side walls 98 of the second tray 72 is inserted into a space between corresponding side segments 81A, 81B. Upon insertion of each of the side walls 98 in the space between the side segments 81A, 81B, the rib (not shown) on the side segment 81B supports the rib 84 (refer to FIG. 4) on the side wall 98.

A pair of side guides 77 is disposed on the first support surface 75A. The side guides 77 are spaced from each other in the right-left direction 8, 9. A right side guide 77 has a left-facing surface which is configured to contact right edges of sheets 50 supported by the first support surface 75A. A left side guide 77 has a right-facing surface which is configured to contact left edges of the sheets 50 supported by the first support surface 75A. The side guides 77 are supported movably in the right-left direction 8, 9 by rails 85 formed in the first support surface 75A. This allows the first support surface 75A to support thereon various sizes of sheets 50 having different lengths in the right-left direction 8, 9.

Second Tray 72

As depicted in FIGS. 3-6, the second tray 72 includes a second bottom plate 82, a front wall 83, and a pair of side walls 98. The second bottom plate 82 has a second support surface 82A configured to support sheets 50. The front wall 83 extends upward from a front end of the second support surface 82A. The side walls 98 extend upward from right and left ends of the second support surface 82A so as to face each other in the right-left direction 8, 9.

The side walls 98 extend in the front-rear direction 6, 7. Each of the side walls 98 has an outer surface (i.e., a right-facing surface of a right side wall 98 and a left-facing surface of a left side wall 98) which includes a rib 84 extending in the front-rear direction 6, 7.

Each of the side walls 98 is provided at a position, in the right-left direction 8, 9, corresponding to a corresponding one of the side walls 81 of the first tray 71 so as to be inserted into a space between the side segments 81A, 81B of the corresponding side wall 81. This restricts the second tray 72 to moving in the front-rear direction 6, 7. In this state, the rib 84 is supported by the rib (not shown) formed on the side segment 81B. Each of the side walls 98 is movable relative to the corresponding side wall 81 in the front-rear direction 6, 7 while being supported by the corresponding side wall 81. In short, the second tray 72 is attached to the first tray 71 movably relative to the first tray 71 in the front-rear direction 6, 7, which is an example of a first direction.

When small size sheets 50 (e.g. A4 size sheets) are accommodated in the feed tray 21, the second tray 71 is moved to the first position (depicted in FIGS. 3, 5, and 11A) at which the second tray 71 is retracted relative to the first tray 71. The second bottom plate 82 is retracted relative to the first bottom plate 75 in the rear direction 7. In this state, the entirety of the second support surface 82A is positioned below and overlaps the first support surface 75A. When the second tray 72 is at the first position, the sheets 50 are supported by the first support surface 75A.

When the second tray 72 is at the first position, the entirety of the second support surface 82A may not necessarily be positioned below the first support surface 75A. For example, when the second tray 72 is positioned at the first position, a most part of the second surface 82A, except for its front end, may be positioned below the first support surface 75A and its front end may protrude in the front direction 6 beyond a front end of the first support surface 75A.

When large size sheets 50 (e.g., A3 size sheets) are accommodated in the feed tray 21, the second tray 71 is moved to the second position (depicted in FIGS. 4, 6, and 11B) at which the second tray 71 is extended relative to the first tray 7. The second position is further frontward than the first position. The second bottom plate 82 is extended in the front direction 6 relative to the first bottom plate 75. In this state, a rear end portion of the second support surface 82A is positioned below and overlaps the first support surface 75A. When the second tray 72 is at the second position, the second support surface 82A overlaps the first support surface 75A over a smaller area than when the second tray 72 is at the first position. In other words, when the second tray is at the first position, the second support surface 82A overlaps the first support surface 75A over a larger area than when the second tray 72 is at the second position. When the second tray 72 is at the second position, a portion of the second support surface 82A, other than its rear end portion, protrudes in the front direction 6 beyond the front end of the first support surface 75A. In this case, the sheets 50 are supported by the first support surface 75A and the portion of the second support surface 82A other than its rear end portion.

The front wall 83 has, at its central portion in the right-left direction 8, 9, a recess 79 recessed in the rear direction 7. A user of the multifunction device 10 grips the recess 79 in order to insert and remove the feed tray 21 in the front-rear direction 6, 7 relative to the printer 11 and in order to move the second tray 72 in the front-rear direction 6, 7 relative to the first tray 71.

Rail 70

Figure 4:
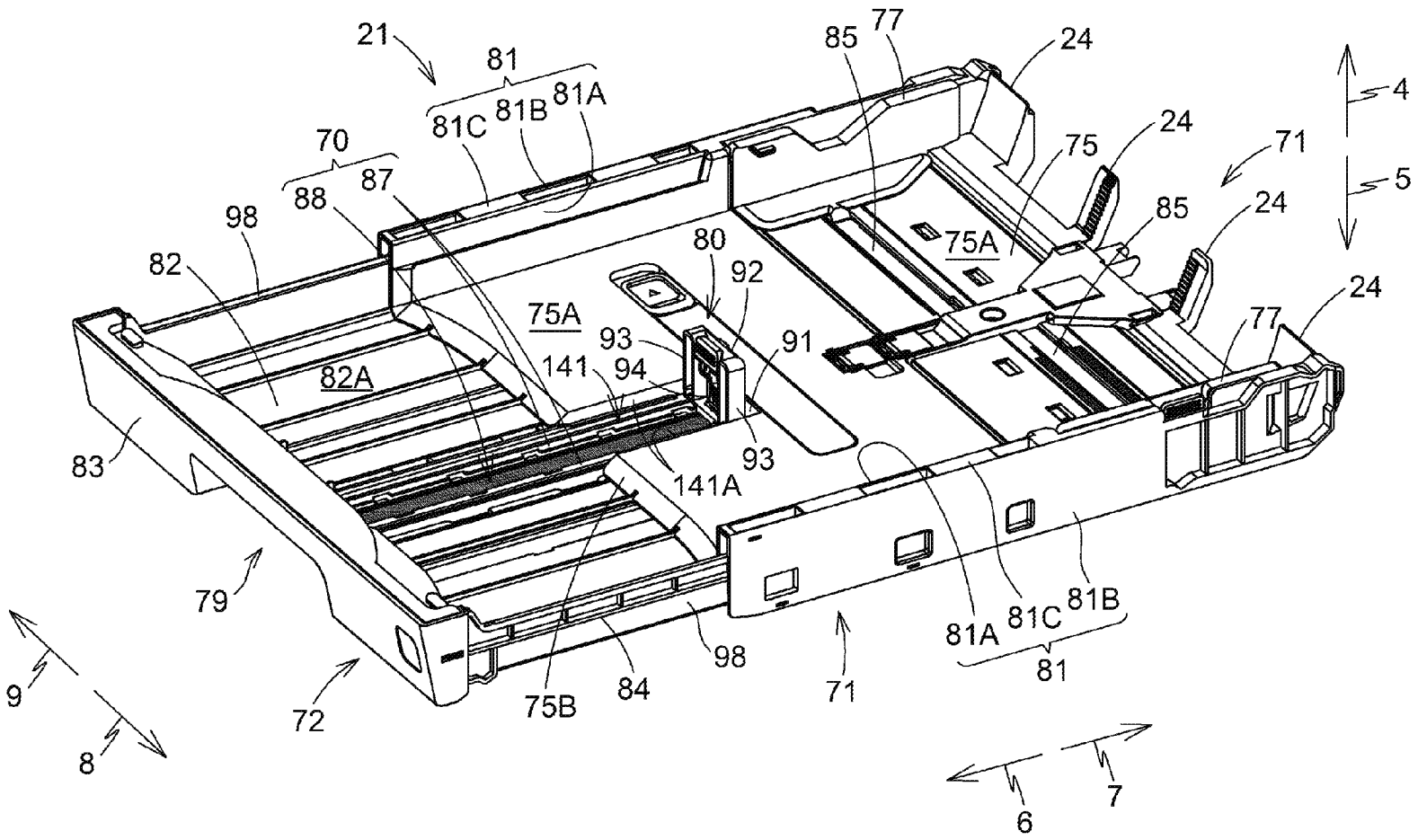
FIG. 4 is a perspective view of the feed tray with the second tray at a second position in the illustrative embodiment according to one or more aspects of the disclosure.
Figure 6:
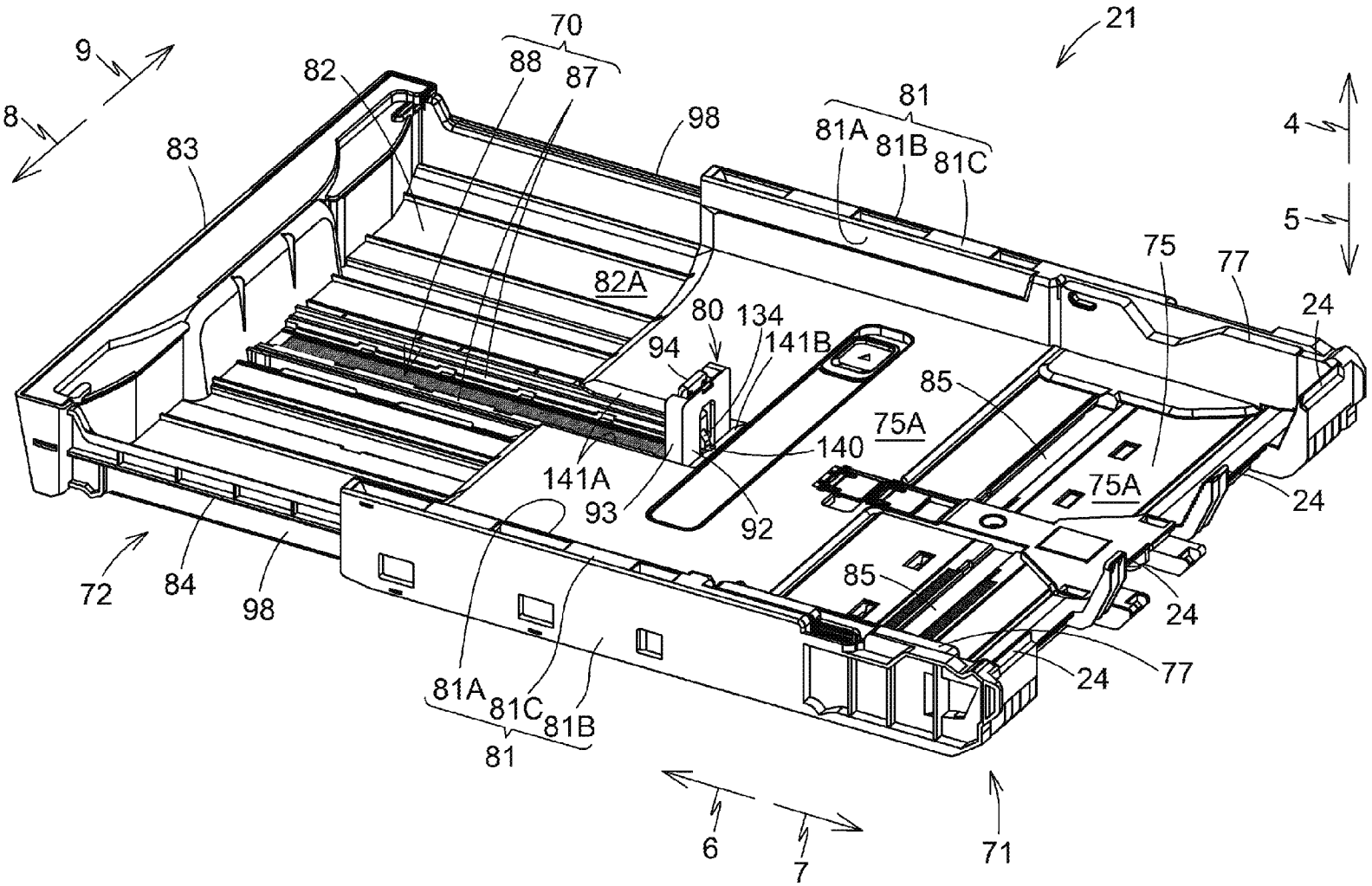
FIG. 6 is a perspective view of the feed tray with the second tray at the second position in the illustrative embodiment according to one or more aspects of the disclosure.
Figure 11A:
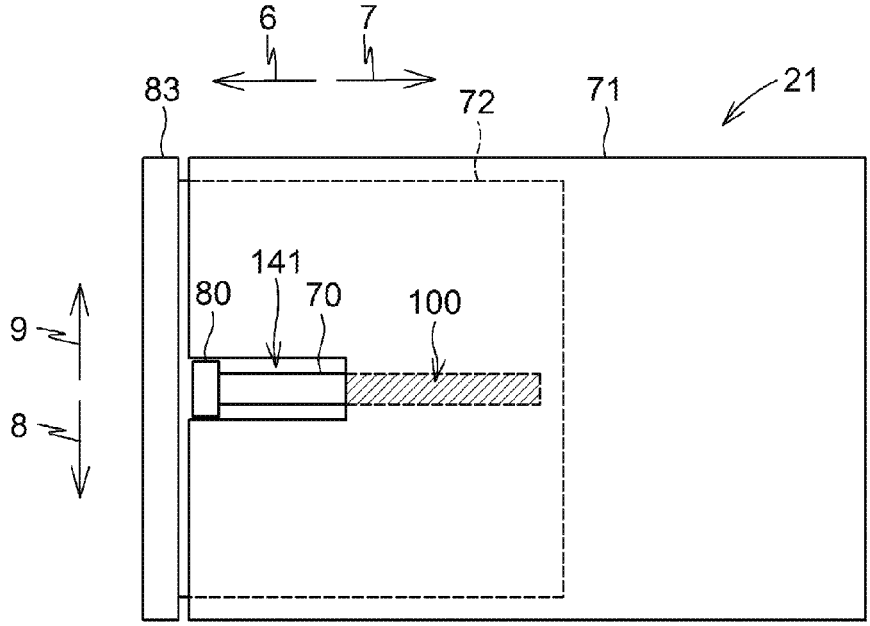
FIG. 11A is a schematic plan view of the feed tray with the second tray at the first position in the illustrative embodiment according to one or more aspects of the disclosure.
Figure 11B:
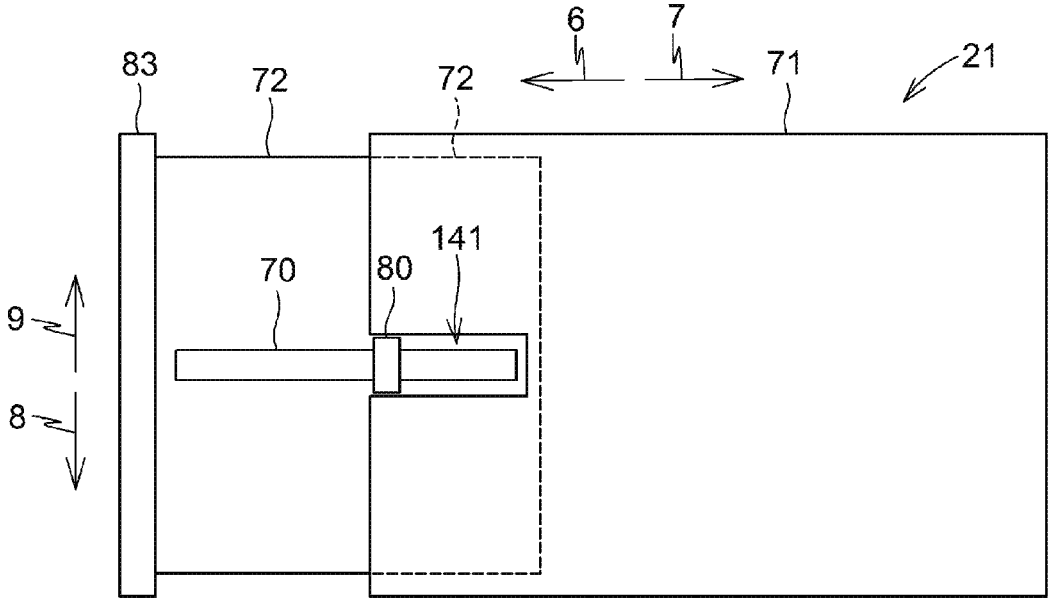
FIG. 11B is a schematic plan view of the feed tray with the second tray at the second position in the illustrative embodiment according to one or more aspects of the disclosure.

As depicted in FIGS. 4, 6, and 11B, a rail 70 is formed in the second support surface 82A of the second tray 72 and extends in the front-rear direction 6, 7. The rail 70 is formed at a central portion in the right-left direction 8, 9. The rail 70 extends in the rear direction 7 from a front end portion of the second support surface 82A.

Figure 3:
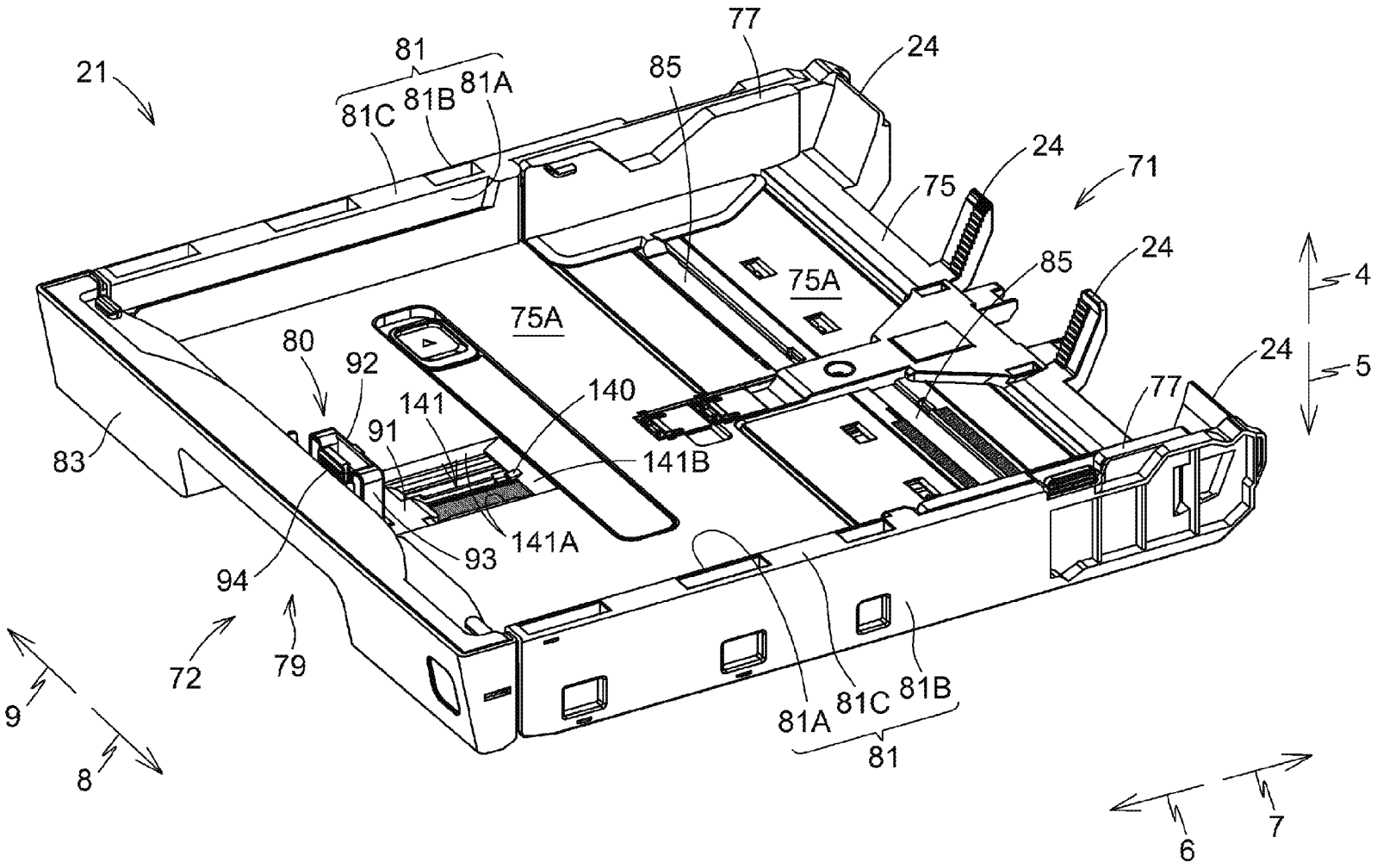
FIG. 3 is a perspective view of a feed tray with a second tray at a first position in the illustrative embodiment according to one or more aspects of the disclosure.
Figure 5:
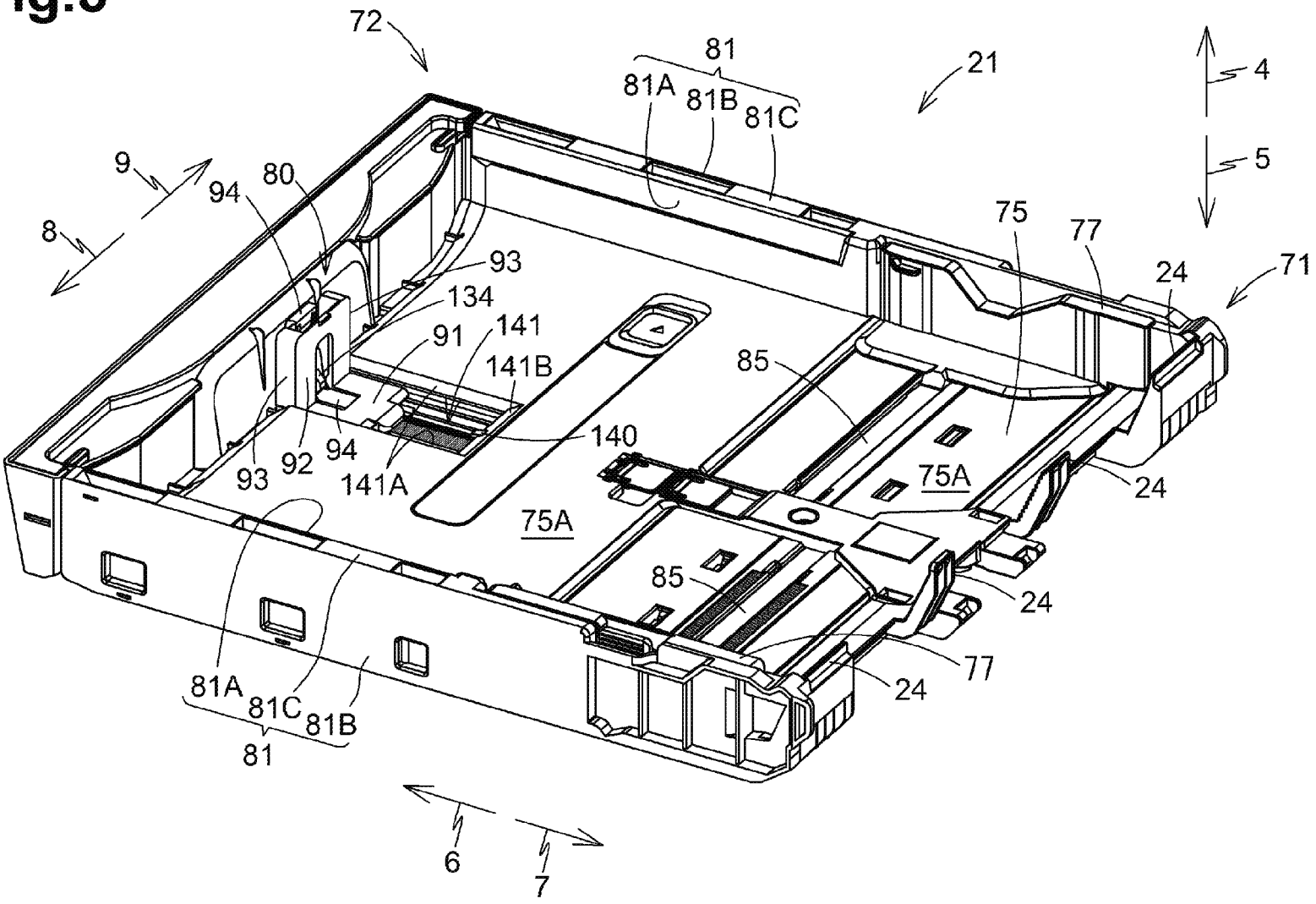
FIG. 5 is a perspective view of the feed tray with the second tray at the first position in the illustrative embodiment according to one or more aspects of the disclosure.

As depicted in FIGS. 3, 5, and 11A, when the second tray 72 is at the first position, a front end portion of the rail 70 does not overlap the first support surface 75A because of a cutout 141, which will be described later. The front end portion of the rail 70 is exposed upward, through the cutout 141, in the feed tray 21. When the second tray 72 is at the first position, a portion, other than the front end portion, of the rail 70 is positioned below and overlaps the first support surface 75A.

A portion of the rail 70 which does not overlap the first support surface 75 when the second tray is at the first position may not be limited to a portion of the rail 70 positioned under the cutout. For example, a front end portion of the second support surface 82A of the second tray 72 at the first position may protrude in the front direction 6 beyond the front end of the first support surface 75A. In this case, the front end portion of the second support surface 82A protruding in the front direction 6 beyond the front end of the first support surface 75A does not overlap the first support surface 75A, either.

Thus, the rail 70 includes an overlap portion 100 (a hatched portion in FIG. 11A) which overlaps the first support surface 75A when the second tray 72 is at the first position.

As depicted in FIGS. 4, 6, and 11B, when the second tray 72 is at the second position, the entirety of the rail 70 does not overlap the first support surface 75A. In other words, the entirety of the rail 70 is exposed upward in the feed tray 21.

Figure 9:
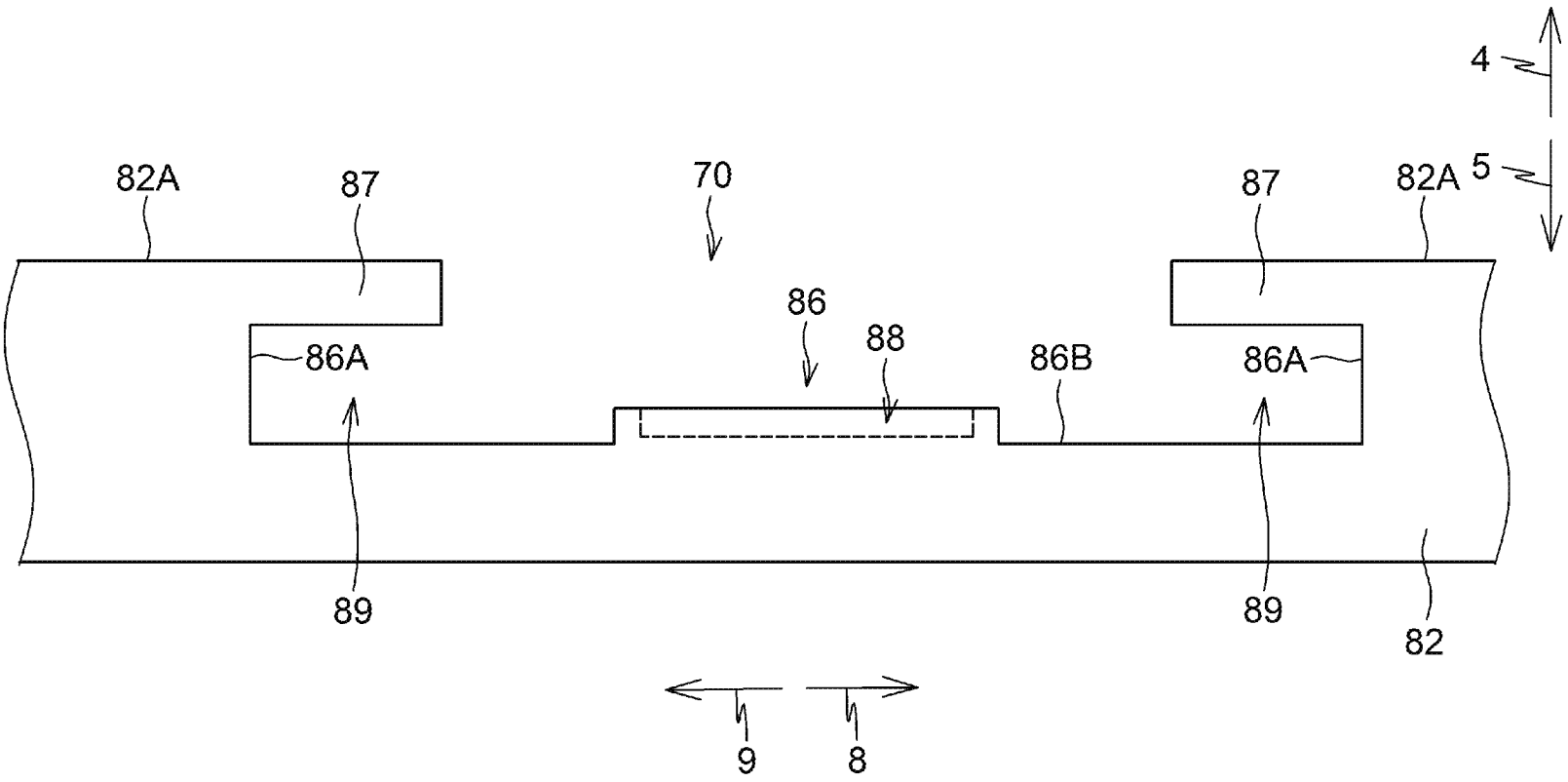
FIG. 9 is a schematic cross-sectional view of a rail taken along an up-down direction and a right-left direction in the illustrative embodiment according to one or more aspects of the disclosure.

As depicted in FIG. 9, the rail 70 has a first recess 86 formed in the second support surface 82A, a pair of protrusions 87 each formed at an upper end of a corresponding side surface 86A of the first recess 86, and at least one engagement portion 88 formed at a central portion in the right-left direction 8, 9 of a bottom surface 86B of the first recess 86. A pair of second recesses 89 is defined by the protrusions 87, the bottom surface 86B, and the side surfaces 86A such that one and the other of the second recesses 89 are recessed in the right direction 8 and in the left direction 9, respectively.

As depicted in FIG. 8, the at least one engagement portion 88 comprises a plurality of notches arranged in the front-rear direction 6, 7. In this embodiment, a plurality of engagement portions 88 are arranged at tight intervals from an front end to a rear end of the rail 70. However, the engagement portions 88 may be arranged at greater intervals than in FIG. 8 and may not be necessarily arranged at even intervals. The number of engagement portions 88 is arbitrary.

Rear Guide 80

As depicted FIGS. 3-6, a rear guide 80 (as an example of a guide member) is supported by the rail 70 movably in the front-rear direction 6, 7. Specifically, The rear guide 80 is movably supported by the rail 70 while protrusions (not shown), which protrude in the right-left directions 8, 9 from a lower end portion of the rear guide 80, are inserted in the second recesses 89 (refer to FIG. 9) of the rail 70, respectively.

The rear guide 80 is configured to contact front edges of sheets 50 supported on the first support surface 75A or on the first support surface 75A and the second support surface 82A. This allows the first support surface 75A and the second support surface 82A to support sheets 50 of various sizes having different lengths in the front-rear direction 6, 7.

The rear guide 80 includes a bottom wall 91, a standing wall 92 extending in the up direction 4 from a front end of the bottom wall 91, side walls 93 protruding in the front direction 6 from right and left ends of the standing wall 92, respectively, and an engagement shifter 94.

A lower surface of the bottom wall 91 includes the protrusions (not shown) to be inserted into the second recesses 89. A rear surface of the standing wall 92 is contactable with front edges of the sheets 50. The engagement shifter 94 will be described in detail later.

Engagement Shifter 94

As depicted in FIGS. 7 and 8, the engagement shifter 94 includes a first plate 131 and a second plate 132.

The first plate 131 extends in the front-rear direction 6, 7. A rear end of the first plate 131 is fixed to the bottom wall 91. A front end of the first plate 131 is coupled to the second plate 132. The second plate 132 protrudes in the up direction 4 from the front end of the first plate 31. The second plate 132 is disposed between the side walls 93 in the right-left direction 8, 9.

The engagement shifter 94 structured as described above is deformable while the rear end of the first plate 131 is fixed to the bottom wall 91. Specifically, the front end of the first plate 131 is deformable in the up-down direction 4, 5. The second plate 132 moves up and down as the front end of the first plate 131 deforms up and down. The second plate 132 is also deformable in the front-rear direction 6, 7. The first plate 131 deforms in the up-down direction 4, 5 by deforming the second plate 132 in the front-rear direction 6, 7.

The first plate 131 includes a protrusion 133. The protrusion 133 protrudes downward from a front end portion of a lower surface of the first plate 131. The protrusion 133 is positioned above the engagement portions 88 and opposes the engagement portions 88 in the up-down direction 4, 5. The engagement portions 88 are an example of first engagement portions, and the protrusion 133 is an example of a second engagement portion.

The second plate 132 includes a contact portion 134. The contact portion 134 protrudes in the rear direction 7 from a lower end portion of a rear surface of the second plate 132. The contact portion 134 has an inclined surface facing rearward and downward. The inclined surface 135 is inclined in an upper rear direction. The inclined surface 135 is inclined such that a portion thereof closer to a contact portion 140 (to be described later) is located at an upper position.

An operative portion 136 is attached to the second plate 132. Specifically, the operative portion 136 covers an upper portion of the second plate 132. The operative portion 136 is operated by a user to move the second plate 132. The operative portion 136 may be made of a material, such as rubber, which is not slippery for the user's hand. The operative portion 136 may be made integrally with the second plate 132 and, in this case, may be made of the same material as the second plate 132.

Figure 7A:
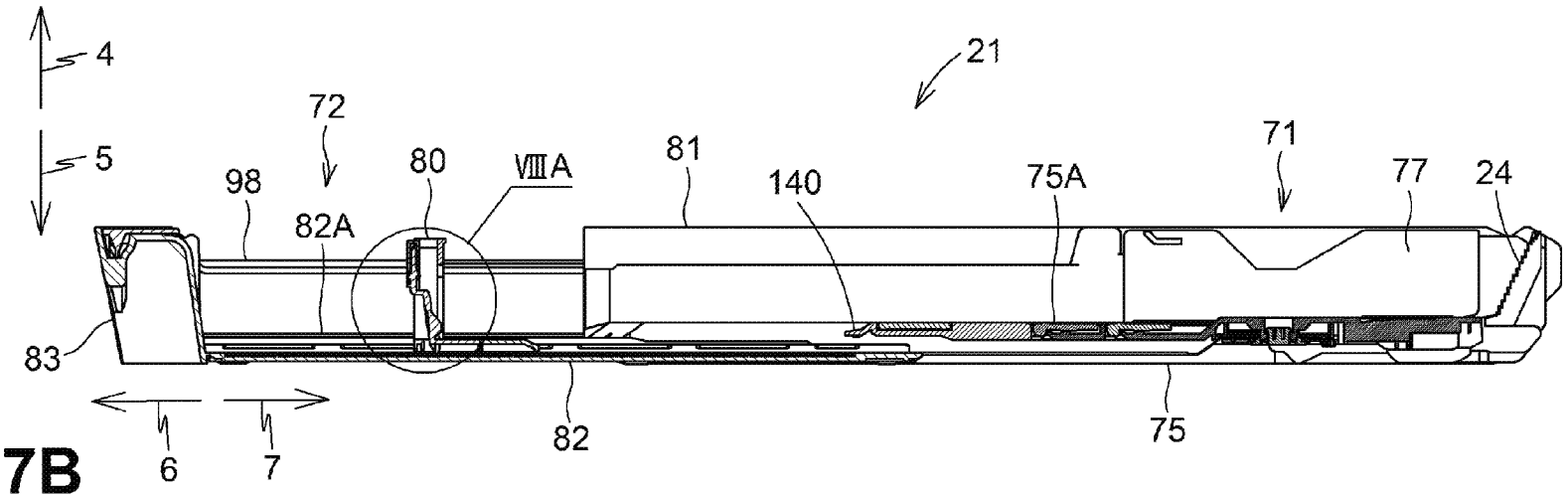
FIG. 7A is a vertical cross-sectional view of the feed tray when the second tray is at the second position and an engagement shifter is in a first state in the illustrative embodiment according to one or more aspects of the disclosure.
Figure 8B:
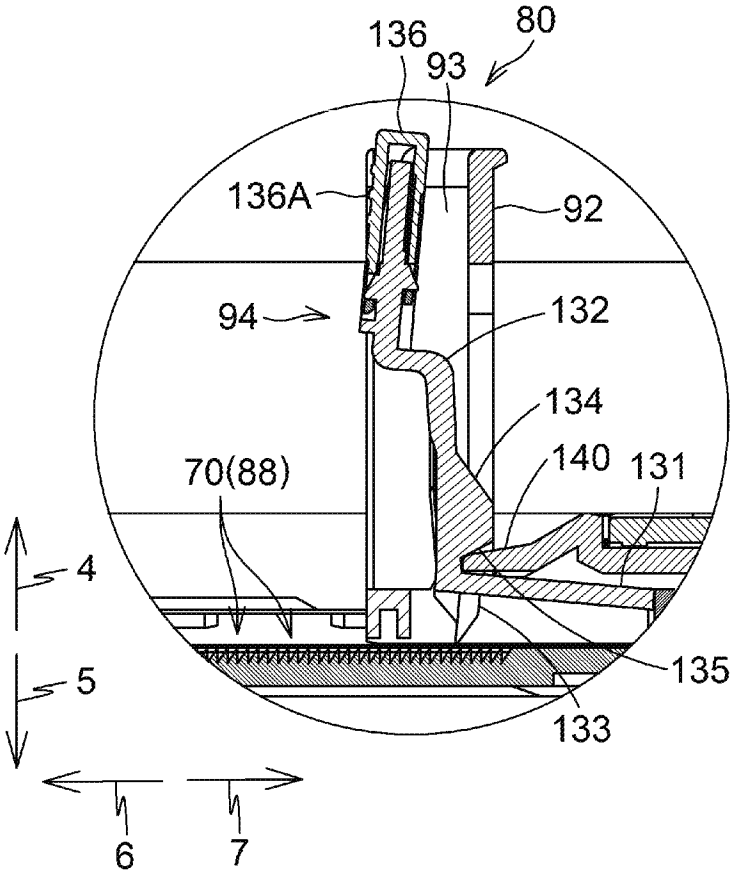
FIG. 8B is an enlarged view of the rear guide and its surrounding components depicted in FIG. 7B in the illustrative embodiment according to one or more aspects of the disclosure.
Figure 8A:
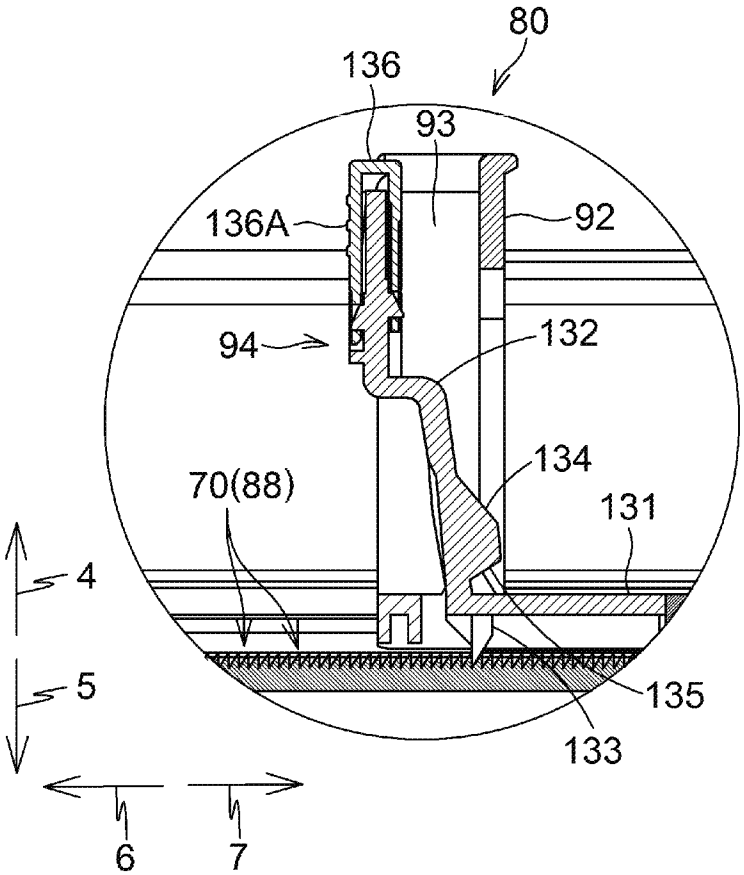
FIG. 8A is an enlarged view of a rear guide and its surrounding components depicted in FIG. 7A in the illustrative embodiment according to one or more aspects of the disclosure.

As depicted in FIGS. 7A and 8A, the protrusion 133 is inserted in one of the engagement portions 88 from above when no external force is applied to the engagement shifter 94. The protrusion 133 fits in one of the engagement portions 88 from above, to thereby engage the rear guide 80 with the one of the engagement portions 88. Consequently, the rear guide 80 is locked from moving in the front-rear direction 6, 7. At that time, the engagement shifter 94 is in a first state.

When an external force is applied to the engagement shifter 94, the protrusion 133 moves out of any one of the engagement portions 88, as will be described in detail below.

Figure 7B:
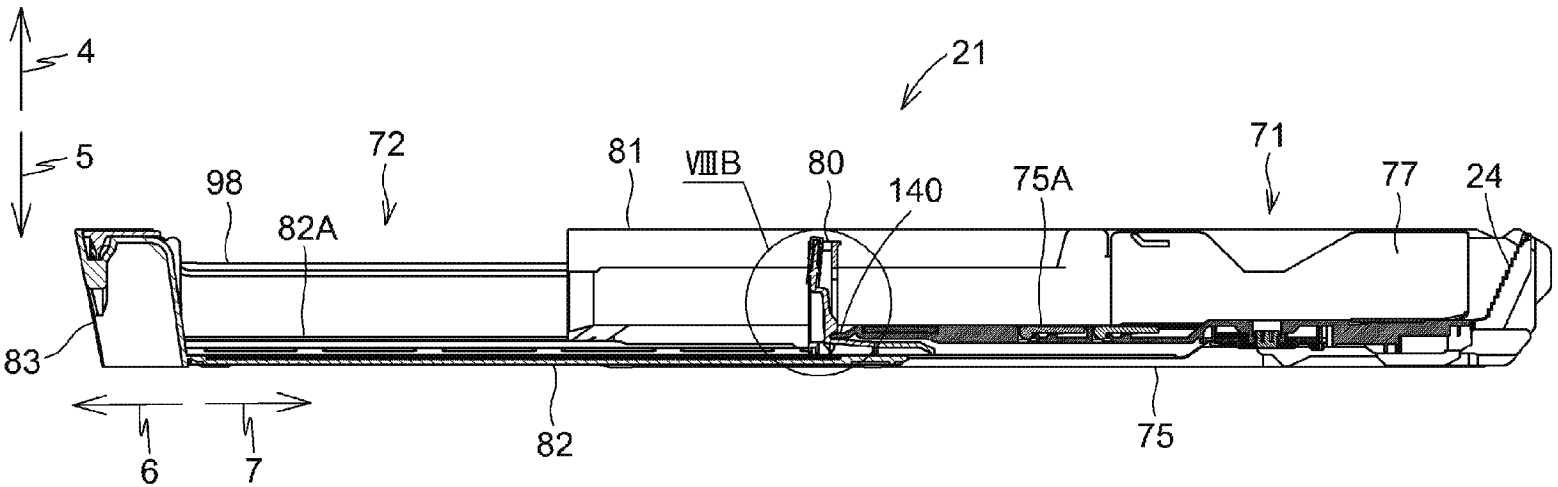
FIG. 7B is a vertical cross-sectional view of the feed tray when the second tray is at the second position and the engagement shifter is in a second state in the illustrative embodiment according to one or more aspects of the disclosure.

When the user pushes a front surface of the operative portion 136 toward the rear direction 7, the second plate 132 moves in the rear direction 7, and the front end of the first plate 131 deforms upward. Also, as will be described later, the first plate 131 deforms upward when the contact portion 134 is pushed by the contact portion 140. As depicted in FIGS. 7B and 8B, the protrusion 133 moves out of any one of the engagement portions 88, to thereby disengage the rear guide 80 from the engagement portions 88. Consequently, the rear guide 80 is unlocked to be movable in the front-rear direction 6, 7. At that time, the engagement shifter 94 is in a second state. The contact portion 140 is an example of a first contact portion, and the contact portion 134 is an example of a second contact portion.

As described above, the engagement shifter 94 is changeable between the first state and the second state.

Cutout 141 and Contact Portion 140

As depicted in FIGS. 3-6, the first bottom plate 75 of the first tray 71 includes a cutout 141 at its front end portion 75B, which is one end portion of the first bottom plate 75 closer to the rear guide 80 than the other end portion. The cutout 141 is formed rearward from the front end portion 75B of the first bottom plate 75. The cutout 141 is defined by a pair of side surfaces 141A spaced in the right-left direction 8, 9 and a deep surface 141B connecting rear ends of the side surfaces 141A.

The cutout 141 and the rail 70 in the second support surface 82A of the second tray 72 are formed at the same positions relative to the right-left direction 8, 9. Specifically, a right one of the pair of side surfaces 141A which define the cutout 141 is located to the right of right ends of the rails 70 and the rear guide 80. A left one of the pair of side surfaces 141A is located to the left of left ends of the rails 70 and the rear guide 80. The cutout 141 is located at a position corresponding to the rail 70 and has a dimension to allow the rear guide to move between the side surfaces 141A. The right-left direction 8, 9, which is perpendicular to the front-rear direction 6, 7, is an example of a second direction.

As depicted in FIGS. 3, 5, and 6, the deep surface 141B of the cutout 141 includes the contact portion 140. The contact portion 140 protrudes in the front direction 6 from the deep surface 141B. The contact portion 140 opposes, in the front-rear direction 8, 9, the contact portion 134 of the engagement shifter 94 of the rear guide 80. In other words, the contact portion 140 and the contact portion 134 are at the same positions relative to the right-left direction 8, 9.

The contact portion 140 and the inclined surface 135 of the contact portion 134 are at the same positions relative to the up-down direction 4, 5. Accordingly, the contact portion 140 is contactable with the inclined surface 135.

Retraction of Second Tray 72

Described below is actions of components (especially the rear guide 80) when the second tray 72 moves from the second position to the first position. In the following description, the rear guide 80 is assumed to be supported by the rail 70 at a position within the overlap portion (hatched portion in FIG. 11A) when the second tray 72 is at the second position. The overlap portion 100 indicates a portion which belongs to the rail 70 and overlaps the first support surface 75A when the second tray 72 is at the first position. In other words, the overlap portion 100 is a portion which belongs to the rail 70 and is not exposed from the first support surface 75A in FIGS. 3 and 5.

When the user holds the recess 79 and pushes the recess 79 in the rear direction 7, the second tray 72 starts moving from the second position to the first position.

At that time, as depicted in FIG. 8A, the protrusion 133 is inserted in one of the engagement portions 88, and thus the rear guide 80 is engaged with the one of the engagement portions 88. Therefore, when the second tray 72 moves in the rear direction 7, the rear guide 80 moves in the rear direction 7 integrally with the second bottom surface 82. The rear guide 80 approaches the deep surface 141B of the cutout 141. The rear guide 80 moves into a deep end of the cutout 141 and contacts the first tray 71. Specifically, the inclined surface 135 of the contact portion 134 formed in the engagement shifter 94 of the rear guide 80 contacts the contact portion 140 formed on the deep surface 141B of the cutout 141 of the first tray 71 (refer to FIGS. 4 and 6).

When the second tray 72 moves further in the rear direction 7 while maintaining this state, the inclined surface 135 guides the contact portion 140 along the inclined surface 135 while applying to the contact portion 140 a rearward and downward force. The inclined surface 135 receives from the contact surface 140 a frontward and upward reaction force. Thus, the second plate 132 moves upward. The front end of the first plate 131 moves upward. The engagement shifter 94 moves upward. Then, the protrusion 133 moves out of any one of the engagement portions 88 (refer to FIG. 8B). Consequently, the rear guide 80 is unlocked to be movable in the front-rear direction 6, 7. As described above, the contact portion 140 contacts the engagement shifter 94 and changes the engagement shifter 94 from the first state to the second state.

When the second tray 72 moves further in the rear direction 7, the second tray 72 moves in the rear direction 7 relative to the first tray 71, and the rear guide 80 moves in the front direction 6 relative to the second tray 72. In other words, only the second tray 72 moves in the rear direction 7 while the rear guide 80 remains at a position in contact with the contact portion 140 of the first tray 71. Accordingly, the second tray 72 is allowed to move in the rear direction 7 relative to the first tray 71 even after the rear guide 80 contacts the first tray 71 during the movement of the second tray 72 in the rear direction 7 relative to the first tray 71.

Effects Obtained by Illustrative Embodiment

According to the illustrative embodiment, the rail 70 is formed in the second support surface 82A. The rail 70 is formed integrally with the second support surface 82A. This obviates the need for providing the rail 70 as a separate part from the second support surface 82A, thereby preventing a cost increase. The second support surface 82A, when positioned below the first support surface 75A, overlaps the first support surface 75A. This obviates the need for providing in the second support surface 82A a slit into which the first support surface 75A is inserted, thereby preventing a decrease in rigidity of the feed tray 21.

According to the illustrative embodiment, the rear guide 80 contacts the first tray 71 when the second tray 72 moves from the second position toward the first position. At that time, the contact portion 140 contacts the engagement shifter 94 and changes the engagement shifter 94 into the second state. This allows the rear guide 80 to move relative to and along the rail 70. Consequently, the rear guide 80 is pushed by the first tray 71 to move relative to the second tray 72. This allows the second tray 72 to move from the second position to the first position without being interfered by the rear guide 80.

According to the illustrative embodiment, when the second tray 72 is at the first position, the rear guide 80 is allowed to move into the cutout 141. This allows the rear guide 80 to move in the front-rear direction 6, 7 even when the second tray 72 is at the first position.

According to the illustrative embodiment, the engagement portions 88 comprise a plurality of notches, and the engagement shifter 94 includes the protrusion 133 and the contact portion 134 having the inclined surface 135. This configuration readily allows the contact portion 140 to contact the engagement shifter 94, thereby changing the engagement shifter 94 from the first state to the second state.

According to the illustrative embodiment, when the contact portion 134 of the second plate 132 contacts the contact portion 140 to be pushed by the contact portion 140, the first plate 131 deforms upward. This allows the engagement shifter 94 to change from the first state to the second state.

Variations

In the illustrative embodiment, as depicted in FIG. 8, the contact portion 134 of the engagement shifter 94 has the inclined surface 135. During the movement of the second tray 72 from the second position toward the first position, the contact portion 140 is guided along the inclined surface 142, thereby changing the engagement shifter 94 from the first state to the second state.

Figure 10A:
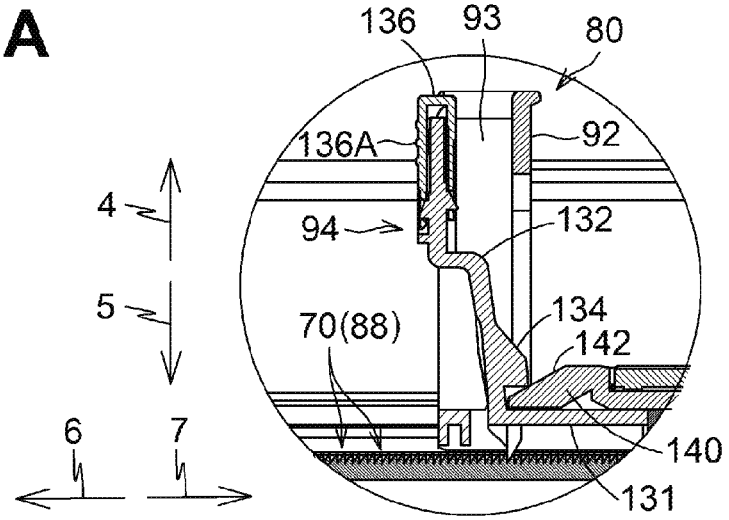
FIG. 10A is a schematic vertical cross-sectional view of a rear guide and its surrounding components in another illustrative embodiment according to one or more aspects of the disclosure.

Nevertheless, in another illustrative embodiment, as depicted in FIG. 10A, a contact portion 140 may have an inclined surface 142. During movement of the second tray 72 from the second position toward the first position, a contact portion 134 may contact the inclined surface 142 and may be guided along the inclined surface 142 such that the engagement shifter 94 moves upward and changes from the first state to the second state. In this case, the inclined surface 142 opposes the engagement shifter 94 (specifically, the contact portion 134) in the front-rear direction 6, 7. The inclined surface 142 faces frontward and the rearward and is inclined in a lower front direction. The inclined surface 142 is inclined such that a portion thereof closer to the engagement shifter 94 is located at a lower position. The inclined surface 142 contacts the contact portion 134 from below.

In the illustrative embodiment, as depicted in FIG. 8, the engagement shifter 94 deforms in contact with the contact portion 140 and changes from the first state to the second state. Nevertheless, the configuration of the engagement shifter 94 may not be limited to that depicted in FIG. 8.

Figure 10B:
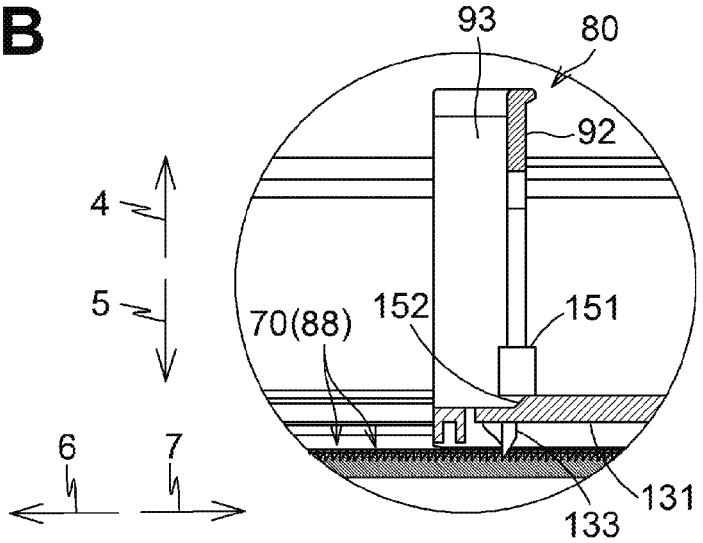
FIG. 10B is a schematic vertical cross-sectional view of a rear guide and its surrounding components when an engagement shifter is in a first state in another illustrative embodiment according to one or more aspects of the disclosure.
Figure 10C:
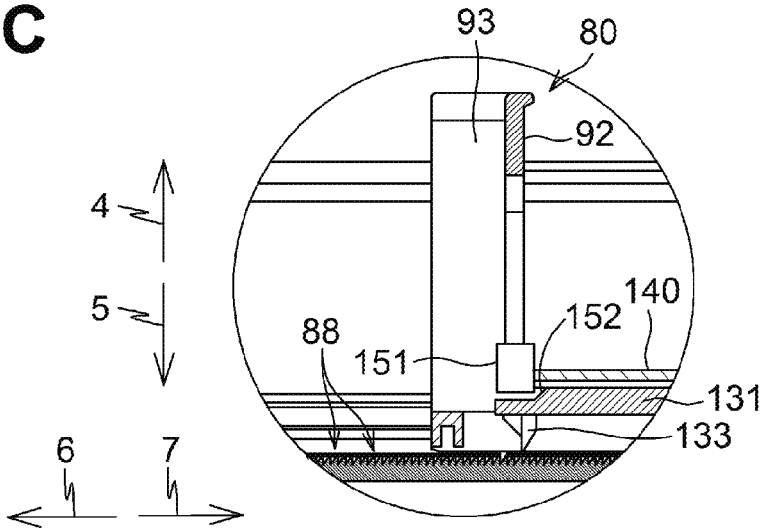
FIG. 10C is a schematic vertical cross-sectional view of the rear guide and its surrounding components when the engagement shifter is in a second state in the other illustrative embodiment according to one or more aspects of the disclosure.

For example, in another illustrative embodiment, as depicted in FIGS. 10B and 10C, an engagement shifter 94 may include a button switch 151. The button switch 151 may be pushed by a contact portion 140 such that the engagement shifter 94 changes from the first state to the second state.

More specifically, the button switch 151 is supported by the standing wall 92 or the side wall 93 movably in the front-rear direction 6, 7. The button switch 151 is urged by a first coil spring (not shown) in the rear direction 7. A first plate 131 of the engagement shifter 94 is urged upward by a second coil spring (not shown) which is separate from the first coil spring. As depicted in FIG. 10B, the button switch 151 presses the first plate 131 from above to move the first plate 131 downward against an urging force of the second coil spring. Consequently, a protrusion 133 is inserted into one of the engagement portions 88 and the rear guide 80 is locked from moving in the front-rear direction 6, 7. The engagement shifter 94 is in the first state.

In this state, when the second tray 72 is moved from the second position toward the first position, the contact portion 140 contacts the button switch 151 from rear and pushes the button switch 151 in the front direction 6 against an urging force of the first coil spring. The button switch 151 is moved away from the first plate 131, which in turn moves upward by the urging force of the second coil spring. Consequently, as depicted in FIG. 10C, the protrusion 133 moves out of any one of the engagement portions 88 and the rear guide 80 is unlocked to be movable in the front-rear direction 6, 7. The engagement shifter 94 changes from the first state to the second state.

When the second tray 72 is moved from the first position toward the second position, the contact portion 140 gets spaced from the button switch 151 and the button switch 151 is urged to return to a position depicted in FIG. 10B by the urging force of the first coil spring. The button switch 151 is guided along an inclined surface 152 of the first plate 131. The first plate 131 is pushed by the button switch 151 to move downward against the urging force of the second coil spring. Consequently, the engagement shifter 94 changes into the first state.

In the configuration depicted in FIGS. 10B and 10C, the engagement shifter 94 changes into the first state when the user pushes the button switch 151 in the front direction 6.

In the above-described illustrative embodiment, the first bottom plate 75 of the first tray 71 includes the cutout 141. Nonetheless, the cutout 141 may not be formed in the first bottom plate 75. In this case, the contact portion 140 is provided at the end portion 75B of the first bottom plate 75 of the first tray 71.

In the above-described illustrative embodiment, the feed tray 21 and the conveying unit are provided in the printer 11. Nonetheless, the feed tray 21 and the conveying unit may be provided in the scanner 12.

While the disclosure has been described in detail referring to the specific embodiments thereof, these are merely examples, and various changes, arrangements and modifications may be applied therein without departing from the spirit and scope of the disclosure.

What is claimed is:

1. A sheet tray comprising:

a first tray including a first support surface configured to support a sheet, and a first contact portion;

a second tray attached to the first tray and movable along a first direction between a first position and a second position, the second tray including:

a second support surface configured to support a sheet and overlap, from below, the first support surface over a first area when the second tray is at the first position, and overlap, from below, the first support surface over a second area when the second tray is at the second position, the second area being smaller than the first area;

a rail formed in the second support surface and extending along the first direction, the rail including an overlap portion configured to overlap the first support surface when the second tray is at the first position; and a plurality of engagement portions disposed along the rail, the plurality of engagement portions of the second tray including a plurality of notches arranged along the first direction; and a guide member supported by the rail and movable along the first direction to contact an edge, in the first direction, of the sheet supported by the second support surface, the guide member including an engagement shifter changeable between a first state in which the guide member is engaged with one of the plurality of engagement portions and locked from moving, and a second state in which the guide member is disengaged from the plurality of engagement portions and movable, wherein the engagement shifter of the guide member includes:

a protrusion configured to fit, from above, into one of the plurality of notches;

a second contact portion opposing the first contact portion of the first tray in the first direction, a first plate extending in the first direction and deformable at one end in the first direction thereof while the other end thereof is fixed, and a second plate extending upward from the one end in the first direction of the first plate, wherein the protrusion is disposed at the first plate, and the second contact portion is disposed at the second plate, wherein the first contact portion of the first tray is configured to change the engagement shifter from the first state to the second state by contacting the engagement shifter during movement of the second tray from the second position toward the first position while the guide member is supported at the overlap portion of the rail, and wherein the engagement shifter is configured to move up when the first contact portion and the second contact portion contact each other during movement of the second tray from the second position toward the first position.

2. The sheet tray according to claim 1, wherein the first tray includes a cutout formed along the first direction in the first support surface from one end thereof proximate to the guide member, the cutout being located at a position corresponding to the rail in a second direction perpendicular to the first direction, and dimensioned to allow the guide member to move thereinto, and the first contact portion is disposed at the cutout to oppose the guide member in the first direction.

3. The sheet tray according to claim 1, wherein the second contact portion includes an inclined surface which is inclined such that a portion of the inclined surface closer to the first contact portion is located at an upper position, and wherein the engagement shifter is configured to move up when the first contact portion contacts and is guided along the inclined surface during movement of the second tray from the second position toward the first position.

4. The sheet tray according to claim 1, wherein the first contact portion includes an inclined surface which is inclined such that a portion of the inclined surface closer to the engagement shifter is located at a lower position, and wherein the engagement shifter is configured to move up when the second contact portion contacts and is guided along the inclined surface during movement of the second tray from the second position toward the first position.

5. A sheet tray comprising:

a first tray including a first support surface configured to support a sheet, and a first contact portion;

a second tray attached to the first tray and movable along a first direction between a first position and a second position, the second tray including:

a second support surface configured to support a sheet and overlap, from below, the first support surface over a first area when the second tray is at the first position, and overlap, from below, the first support surface over a second area when the second tray is at the second position, the second area being smaller than the first area; and a rail extending along the first direction, wherein at least a portion of the rail of the second tray is configured to move in the first direction under the first contact portion of the first tray such that the first contact portion overlaps a part of the rail in a direction orthogonal to the second support surface when the second tray is at the first position; and a guide member supported by the rail and movable along the first direction to contact an edge, in the first direction, of the sheet supported by the second support surface, the guide member being configured to:

move fixedly with the second tray relative to the first tray before the guide member contacts the first contact portion of the first tray during movement of the second tray from the second position toward the first position; and move independently of and relative to the second tray after the guide member contacts the first contact portion during movement of the second tray from the second position toward the first position.

6. The sheet tray according to claim 5, wherein the second tray further includes a plurality of first engagement portions disposed along the rail, and wherein the guide member includes an engagement shifter configured to change, upon contact with the first contact portion of the first tray, from a first state to engage the guide member with one of the plurality of engagement portions to a second state to disengage the guide member from the plurality of engagement portions.

7. The sheet tray according to claim 6, wherein the engagement shifter includes a second contact portion configured to contact the first contact portion, and a second engagement portion configured to engage one of the first engagement portions.

8. The sheet tray according to claim 6, wherein the rail of the second tray includes an overlap portion configured to overlap the first support surface when the second tray is at the first position, and wherein the engagement shifter of the guide member is configured to change into the second state, upon contact with the first contact portion, during movement of the second tray from the second position toward the first position while the guide member is engaged with one of the plurality of first engagement portions which is located in the overlap portion.

9. A sheet tray comprising:

a first tray including a first support surface configured to support a sheet, and a first contact portion;

a second tray attached to the first tray and movable along a first direction between a first position and a second position, the second tray including:

a second support surface configured to support a sheet and overlap, from below, the first support surface over a first area when the second tray is at the first position, and overlap, from below, the first support surface over a second area when the second tray is at the second position, the second area being smaller than the first area, wherein the first contact portion of the first tray overlaps, from above, at least a portion of the second support surface when the second tray is at the first position;

a rail formed in the second support surface and extending along the first direction, the rail including an overlap portion configured to overlap the first support surface when the second tray is at the first position; and a plurality of engagement portions disposed along the rail; and a guide member supported by the rail and movable along the first direction to contact an edge, in the first direction, of the sheet supported by the second support surface, the guide member including an engagement shifter changeable between a first state in which the guide member is engaged with one of the plurality of engagement portions and locked from moving, and a second state in which the guide member is disengaged from the plurality of engagement portions and movable, wherein the first contact portion of the first tray is configured to change the engagement shifter from the first state to the second state by contacting the engagement shifter during movement of the second tray from the second position toward the first position while the guide member is supported at the overlap portion of the rail.

10. The sheet tray according to claim 9, wherein the first support surface includes a cutout formed along the first direction from one end of the first support surface, the cutout being located at a position corresponding to the rail in a second direction perpendicular to the first direction, and dimensioned to allow the guide member to move thereinto, and wherein the rail further includes an exposed portion configured to be exposed through the cutout when the second tray is at the first position.

* * * * *